United States Patent [19]

Forbes

[11] Patent Number: 4,890,341

[45] Date of Patent: Jan. 2, 1990

[54] INVALID'S BATHTUB

[76] Inventor: Joycelyn Forbes, 115 Lenox Rd., #D-6, Brooklyn, N.Y. 11226

[21] Appl. No.: 342,796

[22] Filed: Apr. 25, 1989

[51] Int. Cl.[4] ..... A47K 3/022

[52] U.S. Cl. ..... 4/555; 4/556; 4/559; 4/584

[58] Field of Search ..... 4/555, 556, 578, 661, 4/557, 559, 560, 584, 605, 538; 160/199

[56] References Cited

U.S. PATENT DOCUMENTS 3,662,409 5/1972 Johansson ..... 4/578 X
3,994,330 11/1976 Laby ..... 160/199
4,399,569 8/1983 Houle ..... 4/555
4,523,341 6/1985 Queen ..... 4/555

FOREIGN PATENT DOCUMENTS 1582900 1/1981 United Kingdom ..... 4/557

*Primary Examiner*—Henry K. Artis
*Attorney, Agent, or Firm*—Terry M. Gernstein

[57] ABSTRACT

An invalid's bathtub includes a door that has a rail system that is movable from a first position in which it acts as a guide and safety system for the invalid as he enters or leaves the tub, into a second position in which it forms a continuation of a safety rail system located inside the tub. The rail system also operates a lock which locks the door to the tub.

8 Claims, 2 Drawing Sheets

INVALID'S BATHTUB

TECHNICAL FIELD OF THE INVENTION

The present invention relates to the general art of plumbing fixtures, and to the particular field of bathtubs. Specifically, the present invention relates to bathtubs for use by invalids.

BACKGROUND OF THE INVENTION

The bathtubs that are commonly in use of necessity have high sides so as to prevent the escape of water. While the average person may easily step over the sides of such bathtub, there are many invalid persons who find it impossible to step over the sides of the bathtub and become seated therein.

Accordingly, there have been many designs proposed to ease the ingress and egress of such invalids into and out of a bathtub, see for example, the invalid's bathtub disclosed in U.S. Pat. No. 2,977,604, the disclosure of which is incorporated herein by reference.

However, while somewhat successful in easing the ingress and egress of invalids with respect to bathtubs, such designs still do not provide the full measure of safety necessary to an invalid when using a bathtub. It must be remembered that such invalids may be quite infirm on their balance, and moving into or out of a slippery bathtub merely worsens the problems associated with such infirmity.

Still further, present designs, such as the incorporated design, do not provide a rail in the tub that will completely circumscribe the entire tub. If there is an access door associated with the tub, the area of the door has been left without a rail, or the rail has been located outside of the tub, as is the case with the incorporated patent. Such a situation may not be desirable since the invalid may need a rail support in the tub as well, and any gaps in such rail are undesirable.

Therefore, there is a need for an invalid's bathtub that has an access door that provides a full measure of support and guidance to the invalid using the tub during ingress and egress, and which also has a rail located inside the tub and which completely circumscribes the tub, including the area of the tub adjacent to the door.

OBJECTS OF THE INVENTION

It is a main object of the present invention to provide an invalid's bathtub that has means to improve the safety thereof during ingress and egress to and from the tub.

It is another object of the present invention to provide an invalid's bathtub that has a safety rail in the tub that can completely surround the tub when the tub is in use.

SUMMARY OF THE INVENTION

These, and other, objects, are achieved by an invalid's bathtub that has a door with a movable safety rail thereon. The door is movable between a closed position and an open position, and the rail is movable in a track. The rail includes a plurality of telescoping sections and a collapsible support post that is connected to a door lock. The rail is movable from a first position in which it can act as a guide and a support for someone entering and leaving the tub into a position in which it forms part of the safety rail structure located inside the tub. The rail support post is movable and is connected to a lock that is actuated when the rail is moved to lock the door to the tub wall or to unlock the door from the wall.

In this manner, the invalid's bathtub embodying the present invention will provide a safety rail to a tub user while that user is moving into or out of the tub, and will also provide a safety rail inside the tub that will completely surround the inside of the tub to provide further safety to the user.

DETAILED DESCRIPTION OF THE PREFERRED EMBODIMENT OF THE INVENTION

Figure 1:
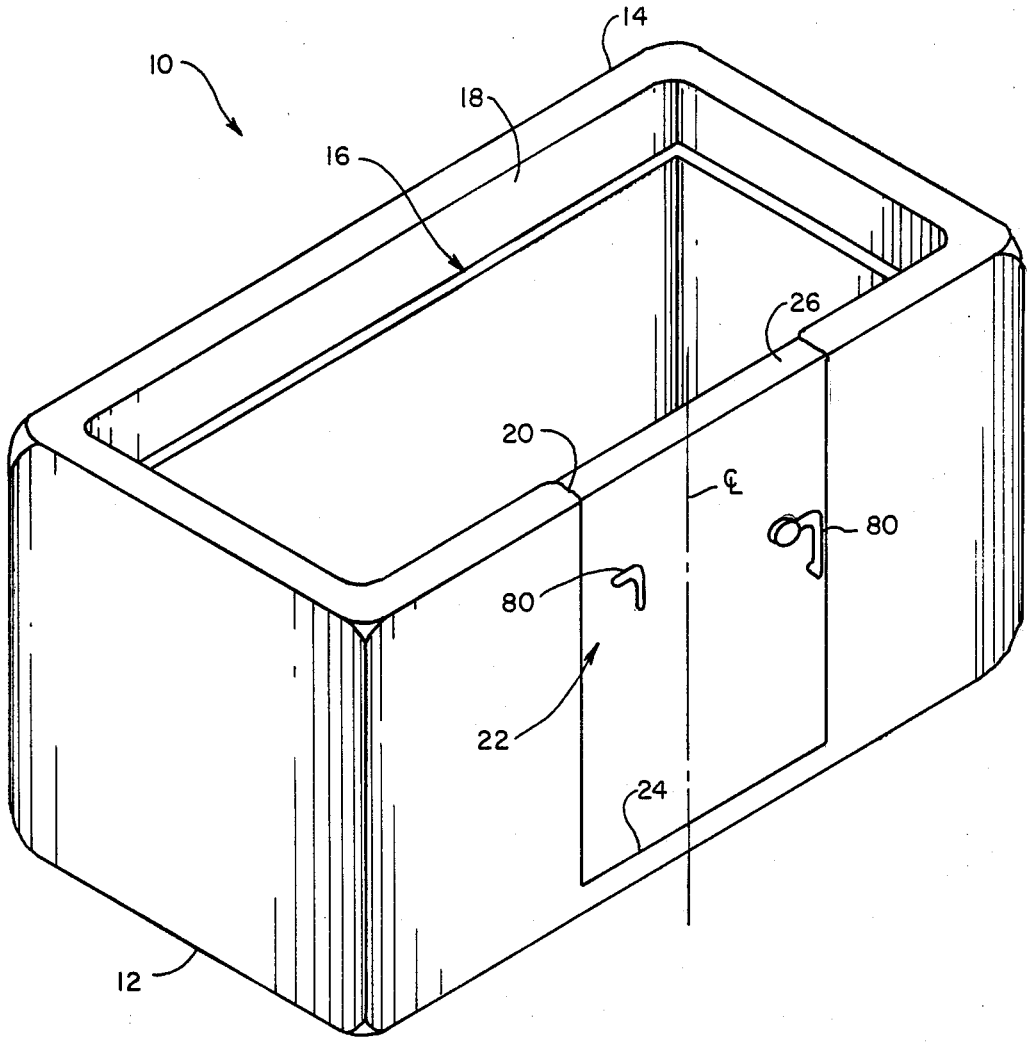
FIG. 1 is a perspective of the invalid's bathtub of the present invention in the closed configuration.

Shown in FIG. 1 is an invalid's bathtub 10 embodying the present invention. As shown in FIG. 1, the tub 10 includes a bottom 12 having a wall 14 in upstanding surrounding relationship therewith. The tub 10 will include the plumbing usual to such tubs, and will be double walled as is disclosed in the incorporated U.S. Pat. No. 2,977,644.

The tub 10 further includes a safety rail 16 that is mounted on inner surface 18 of the wall 14 to completely surround the inner portion of the tub. The safety rail 16 is thus in a position to provide support to a user of the tub 10 when that user is in the tub. To be most effective, the safety rail 16 is located in a position near the top of the wall. Since the safety rail completely surrounds the tub so that there is no gap in that rail, should a user suddenly begin to fall, it is likely that there will be a safety rail in position to be grasped. If there were a gap in that rail 16, it is possible that the user would reach for the rail, and miss it through such gap. The complete circumnavigation of the tub by the rail 16 effectively prevents such possibility.

The tub 10 further includes an access opening 20 in the wall 14. As discussed in disclosures such as the incorporated patent, the access opening permits an invalid to enter or leave the tub 10 without requiring such invalid to step over the wall. The access opening 20 is covered by a door 22 to close the tub. The door 22 includes a longitudinal axis CL and is mounted on the tub wall at a bottom edge 24 by a hinge means to pivot up and down.

Figure 2:
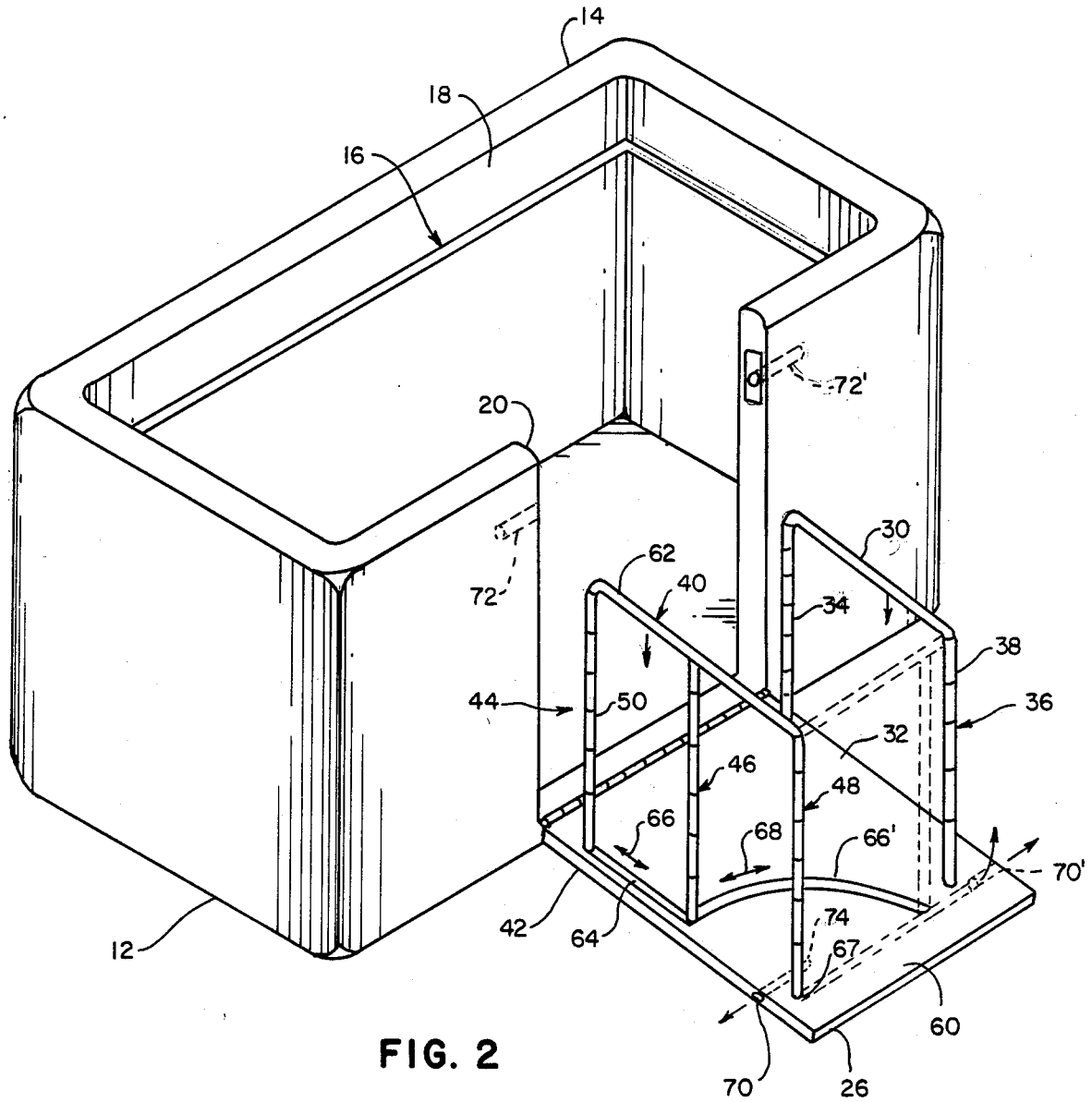
FIG. 2 shows the invalid's bathtub of the present invention in the open configuration showing the safety rail on the door and on the inner surface of the tub.

As best seen by comparing FIGS. 1 and 2, the access opening 20 is opened and closed by swinging the door 22 from the upright, access opening covering condition shown in FIG. 1 to the access opening uncovering condition shown in FIG. 2. In the FIG. 2 open position, the door is oriented to have an upper edge 26 engage the floor around the tub and to slant upwards toward the tub to form a ramp. The user then moves over the ramp to enter or leave the tub in the manner suggested by the disclosure of U.S. Pat. No. 2,075,933, the disclosure of which is incorporated herein by reference.

As best shown in FIG. 2, the door includes a rail 30 that extends along the longitudinal axis CL of the door near one side 32 of the door. The rail 30 includes first and second support posts 34 and 36 that are each formed of a plurality of telescoping sections, such as sections 38 shown on support post 36. The telescoping sections 38 are lengthwise collapsing, and have lengths selected to raise the post 36 higher than the post 34 whereby the rail 30 is level and at a height suitable for guiding and supporting a user moving over the sloping ramp formed by the door. All of the telescoping sections of the rails of the bathtub 10 include ball and receptacle locks similar to those found on umbrellas. For example, the locks of the post 36 are locked by a spring or the like forcing the ball on one section into the receptacle on an adjoining section so that the adjacent sections are fixed in the extended, FIG. 2, condition, and are operated by forcing the ball out of the receptacle to free the sections 38 from each other to permit the sections to be collapsed when the door is in the FIG. 1 closed position to move the rail 30 out of the way. The sections 38 are small enough, so that in such collapsed configuration, the rail 30 is closer to the wall inner surface 18 than is the rail 16.

The door also includes a second rail 40 which is located adjacent to the other side 42 of the door. The second rail 40 cooperates with the first rail 30 to provide a dual-railed safety path for the user of the tub.

The second rail 40 includes three support posts 44, 46 and 48, and these support posts are similar to the support posts 34 and 36 in that they are formed of a plurality of telescopingly co-operating sections, such as sections 50 shown in support post 44. The support posts 44–48 are sized to correspond to the sizes of the support posts 34 and 36 to position the rail 40 in a level condition when the door is open and forming a sloping ramp as shown in FIG. 2. However, the support posts 44–48 are sized to locate the rail 40 in a position to form a continuation of the rail 16 when the door is closed so that the rail 40 will complete the rail 16 in order to ensure that the user of the tub will have a rail 16 that completely surrounds the tub.

The rail 40 is mounted on the door inner surface 60 to be movable from the full-line position shown in FIG. 2 extending along the longitudinal axis of the door and into the tub to a position extending essentially perpendicular to that longitudinal centerline and forming a continuation of the rail 16 as indicated in phantom lines in FIG. 2. The rail 40 includes a plurality of telescoping sections 62 so that the rail 40 can be collapsed to move the support post 44 can be moved toward and away from the support post 46.

The means by which the rail 40 is moved from the full line orientation to the phantom line orientation includes a track-forming slot 64 defined in the door through which the support post 44 moves toward and away from the support post 46 as indicated by double-headed arrow 66 so that these posts 44 and 46 are positioned in a side-by-side manner after the rail 40 has collapsed. The means further includes an arcuate track-forming slot 66' formed in the door and through which the side-by-side support posts 44 and 46 move toward and away from the door edge 26 as indicated by double-headed arrow 68.

As the side-by-side support posts 44 and 46 are moved in the slot 66', the post 48 rotates about its longitudinal axis with respect to the door. The support post 48 is thus mounted in a foot bearing 67 which permits such rotational movement.

In the phantom line position, the rail 40 will form a continuation of the rail 16 when the door is closed. The rail 40 can be rotated from the FIG. 2 full-line configuration to the phantom line configuration by grasping the rail 40, swinging the door closed using the rail, collapsing the support posts toward the door and then moving the rail along track 64 to collapse that portion of the rail, and then, while still grasping the rail 40, moving the partially collapsed rail in track 66' to orient that partially collapsed rail into position to complete the rail 14.

Figure 3:
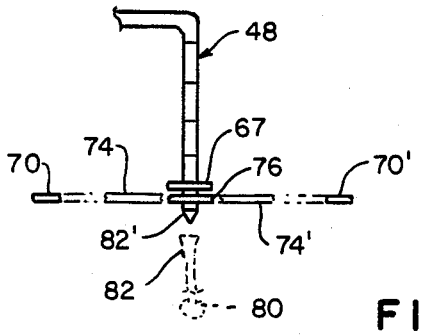
FIG. 3 shows the mechanism used to lock the door to the tub.

The door also includes a means to lock the door to the wall 14. This means is best shown in FIGS. 2 and 3 and includes a bolt 70 slidably mounted on the door to extend out of the side 42 and a striker plate in the wall 14 and having a chamber 72 located to receive and accommodate the bolt 70 when that bolt is extended after the door is closed. There are two bolts and two chambers, but only one will be described since both are similar.

Referring to FIG. 3, it is seen that the bolt 70 is mounted on a rack 74 that is slidably mounted on the door adjacent to the foot bearing 67 supporting the post 48. The post 48 includes a pinion 76 that engages the rack 74 to move that rack longitudinally as the post 48 rotates. Such longitudinal movement of the rack will force the bolt out of and retract the bolt into the door as the post 48 is rotated clockwise and counterclockwise respectively. A similar rack 74' is connected on the diametrically opposite side of the pinion to operate a second bolt 70' located on the other side 32 of the door in a similar manner to co-operate with a striker plate chamber 72'. The second rack 74' is only schematically indicated in FIG. 3 for the sake of brevity.

The door also includes a handle 80 as shown in FIG. 1. The handle 80 is connected to the support post 48 by a bearing 82 indicated in FIG. 3 to rotate that post clockwise and counterclockwise to lock and unlock the door from the outside of the tub when the door is closed. The post 48 includes a pinion-like bottom end 82' and the bearing 82 includes a co-operatingly formed receptacle so that the post 48 will be locked to the handle by the bearing 82 to be rotated when the handle is rotated. The door can thus be locked and unlocked from outside the tub using the handle 80 to rotate the post 48 or by grasping the rail 40 and moving that rail in track 64 to rotate the post.

Suitable seals are also included so that the tub 10 will not leak when filled with water.

It is to be understood that while certain forms of the present invention have been illustrated and described herein, it is not to be limited to the specific forms or arrangement of parts described and shown.

What is claimed is:

1. An invalid's bathtub comprising:

(A) a bottom;

(B) a wall surrounding said bottom;

(C) an access opening in said wall through which an invalid who may be in a wheelchair passes to enter the bathtub;

(D) a door for closing said access opening, said door having a longitudinal axis that is oriented to extend into the bathtub and being connected to said wall at a bottom end to form a ramp into the bathtub when said door is in an open position uncovering said access opening, said door being movable into a closed position covering said access opening with said longitudinal axis extending essentially vertically upright;

(E) a support rail mounted on said door to be movable between a first position extending along said longitudinal axis and a second position extending perpendicular to said door longitudinal axis.

2. The invalid's bathtub defined in claim 1 further including a lock means on said door to lock said door to said wall when said door is in said closed position, said lock means being connected to said rail to be operated by said rail.

3. The invalid's bathtub defined in claim 2 wherein said rail includes a plurality of telescoping sections.

4. The invalid's bathtub defined in claim 3 wherein said lock means includes a bolt movably mounted on said door and a chamber defined in said wall for receiving said bolt.

5. The invalid's bathtub defined in claim 4 wherein said lock means further includes a means for moving said bolt into said chamber as said rail is moved from said first position extending along said door longitudinal axis into said second position extending perpendicular to said door longitudinal axis.

6. The invalid's bathtub defined in claim 5 wherein said rail includes a support post rotatably mounted on said door, said support post rotating with respect to said door as said rail is moved from said first position extending along said door longitudinal axis to another position, and said lock means moving means includes a pinion on said support post to rotate therewith, and a rack engaged with said pinion to be moved as said pinion is rotated, said rack being connected to said bolt to move said bolt as said rack is moved.

7. The invalid's bathtub defined in claim 6 wherein said rail further includes a second support post and said door further includes a track into which said second support post fits and is guided as said rail is moved between said first and said second positions.

8. The invalid's bathtub defined in claim 7 further including a handle on said door, said handle being connected to said support post.

* * * * *